US011186931B2

(12) United States Patent
Hanaya et al.

(10) Patent No.: US 11,186,931 B2
(45) **Date of Patent: *Nov. 30, 2021**

(54) PROCESS FOR PRODUCING NEEDLE-PUNCHED NONWOVEN FABRIC

(71) Applicant: UNITIKA LTD., Amagasaki (JP)

(72) Inventors: Kazutoshi Hanaya, Osaka (JP); Toru Takahashi, Okazaki (JP); Hideaki Kaminokado, Osaka (JP); Masaya Akao, Tokyo (JP); Yusuke Nagatsuka, Okazaki (JP)

(73) Assignee: UNITIKA LTD., Hyogo (JP)

( * ) Notice: Subject to any disclaimer, the term of this patent is extended or adjusted under 35 U.S.C. 154(b) by 143 days.

This patent is subject to a terminal disclaimer.

(21) Appl. No.: 16/603,937

(22) PCT Filed: Apr. 10, 2018

(86) PCT No.: PCT/JP2018/015104

§ 371 (c)(1),
(2) Date: Oct. 9, 2019

(87) PCT Pub. No.: WO2018/190342

PCT Pub. Date: Oct. 18, 2018

(65) Prior Publication Data

US 2020/0063303 A1 Feb. 27, 2020

(30) Foreign Application Priority Data

Apr. 12, 2017 (JP) ..... JP2017-078721

(51) Int. Cl.

| | |
|---|---|
| ***D04H 1/485*** | (2012.01) |
| ***D04H 1/4382*** | (2012.01) |
| ***D04H 1/541*** | (2012.01) |
| *A47L 13/16* | (2006.01) |
| *D04H 1/435* | (2012.01) |
| *D04H 1/559* | (2012.01) |

(52) U.S. Cl.

CPC ..... *D04H 1/43828* (2020.05); *D04H 1/4382* (2013.01); *D04H 1/43835* (2020.05); *D04H 1/485* (2013.01); *D04H 1/5412* (2020.05); *D04H 1/5418* (2020.05); *A47L 13/16* (2013.01); *D04H 1/435* (2013.01); *D04H 1/559* (2013.01)

(58) Field of Classification Search

None

See application file for complete search history.

(56) References Cited

U.S. PATENT DOCUMENTS

| | | | | |
|---|---|---|---|---|
| 3,437,063 | A * | 4/1969 | Battersby ..... | C08L 2666/18 156/218 |
| 2015/0133019 | A1 | 5/2015 | Mori et al. | |
| 2020/0063304 | A1* | 2/2020 | Hanaya ..... | D01F 8/14 |

FOREIGN PATENT DOCUMENTS

| | | | |
|---|---|---|---|
| CN | 101713109 | | 5/2010 |
| CN | 104379826 | | 2/2015 |
| JP | 59-15530 | A * | 1/1984 |
| JP | 9-119056 | | 5/1997 |
| JP | 10-025652 | | 1/1998 |
| JP | 10-298828 | | 11/1998 |
| JP | 2001-054709 | | 2/2001 |
| JP | 2003-166159 | | 6/2003 |
| JP | 2003-171826 | | 6/2003 |
| JP | 2003-325411 | | 11/2003 |
| JP | 2016-211081 | | 12/2016 |
| JP | 2018-009256 | | 1/2018 |
| JP | 6313841 | | 4/2018 |

OTHER PUBLICATIONS

Machine Translation of Japanese Patent 59-15530, Date Unknown.*
International Preliminary Report on Patentability issued for PCT/JP2018/015104, dated Oct. 15, 2019, 7 pages.
International Search Report of PCT/JP2018/015104, dated Jun. 5, 2018, 5 pages including English translation.
Office Action issued for Chinese Patent Application No. 201880024253.9, dated Jun. 22, 2021, 22 pages including machine translation.

* cited by examiner

*Primary Examiner* — Jeffry H Aftergut
(74) *Attorney, Agent, or Firm* — Hamre, Schumann, Mueller & Larson, P.C.

(57) ABSTRACT

[Problem] To provide a process for producing a needle-punched nonwoven fabric with which, when finished by embossing, it is possible to obtain a hardly fluffing and distinct rugged pattern.

[Solution] Sheath-core composite fibers are accumulated and a fibrous web is formed. The core component of the sheath-core composite fiber is formed from a copolymer of ethylene glycol and terephthalic acid. The sheath component is formed from a copolymer of ethylene glycol, adipic acid, terephthalic acid, isophthalic acid and diethylene glycol. The sheath-core composite fibers are three dimensionally interlaced with each other by needle-punching the web, to obtain the needle-punched nonwoven fabric. The needle-punched nonwoven fabric is passed through heated embossed roll to provide a rugged pattern on a surface. During the process, the sheath component are softening melted and melt bonded between the sheath-core composite fibers to obtain an embossed nonwoven fabric having a distinct rugged pattern.

7 Claims, No Drawings

PROCESS FOR PRODUCING NEEDLE-PUNCHED NONWOVEN FABRIC

TECHNICAL FIELD

The present invention is related to a process for producing a needle-punched nonwoven fabric having excellent thermoformability.

BACKGROUND ART

Hitherto, it has been conducted that fibrous web obtained by accumulating sheath-core composite fibers is embossed or needle-punched to obtain nonwoven fabric (Patent Literature 1). For example, the patent literature 1 discloses that sheath-core composite filaments, of which core component is formed from high melting point polyester and sheath component is formed from low melting point polyester copolymer, are accumulated to form filamentous web which is partially heat compressed by an embossed roll to obtain nonwoven fabric. According to the Examples of the patent literature 1, the high melting point polyester is a polyethylene terephthalate obtained by condensed-copolymerizing ethylene glycol and terephthalic acid. The low melting point polyester copolymer is a polyester copolymer of ethylene glycol, terephthalic acid and isophthalic acid.

The filamentous web or nonwoven fabric obtained from the sheath-core composite filaments, however, has problems of heavy surface fluffing and does not obtain distinct rugged patterns on a surface, when it is subjected to embossing process. In addition, the resulting nonwoven fabric has problems of not obtaining desired stereoscopic shape matched to a mold unless heating and pressing conditions are severely controlled, when it is subjected to a heat molding process to produce a stereoscopic shape using the mold.

CITATION LIST

Patent Literature

[PTL 1]
JP 2001-54709 A (paragraphs [0002] and [0032])

SUMMARY OF INVENTION

Technical Problem

The present invention is to provide a process for producing a needle-punched nonwoven fabric which can obtain distinct rugged patterns on a surface without surface fluffy. The present invention also provides a process for producing a needle-punched nonwoven fabric which can be easily thermoformed into a desired shape at a wide range of heat and pressure conditions.

Solution to Problem

The present invention can solve the above problems by using a specific fiber as a fiber constituting a needle-punched nonwoven fabric. Accordingly, the present invention is to provide a process for producing a needle-punched nonwoven fabric, which comprises the following steps:

a first step of forming a web by accumulating sheath-core composite fibers in which the core is formed from a copolymer of ethylene glycol and terephthalic acid and the sheath is formed from a copolymer of ethylene glycol, adipic acid, terephthalic acid and isophthalic acid; and/or diethylene glycol, a second step of needle-punching the fibrous web to three-dimensionally interlace the sheath-core composite fibers.

In the present invention, a fibrous web is produced from a specific sheath-core composite fiber which constitutes a structured fiber. In this context, the sheath-core composite filament is consisted of a core component formed from a copolymer of ethylene glycol and terephthalic acid and a sheath component formed from ethylene glycol, adipic acid, telephthalic acid and isophthalic acid and/or diethyelene glycol. The copolymer for the core component is a polyester of ethylene glycol as diol component and terephthalic acid as dicarboxylic acid. The dicarboxylic acid can contain a very small amount of another dicarboxylic acid, such as isophthalic acid and the like. The copolymer constituting the core component preferably has a melting point of about 260° C. and a glass transition temperature of about 70 to 80° C. The copolymer constituting the sheath component is a copolymerized polyester obtained by a dehydration condensation of ethylene glycol and if any diethylene glycol as diol component and adipic acid, terephthalic acid and if any isophthalic acid as dicarboxylic acid component. Either diethylene glycol or isophthalic acid should be employed and preferably both are employed. Mixing diethylene glycol and/or isophthalic acid can enhance thermoformability of the resulting fiber. When diethylene glycol is mixed to the diol component, ethylene glycol: diethylene glycol may be within a range of 10:0.05 to 0.5 (molar ratio). A mixing ratio of adipic acid and terephthalic acid as dicarboxylic acid component can be any ratio, but adipic acid: terephthalic acid may be within a range of 1:1 to 10 (molar ratio). When isophthalic acid is added in the dicarboxylic acid component, it is general that isophthalic acid:adipic acid:terephthalic acid can be within a range of 0.04 to 0.6:1:1 to 10 (molar ratio). Melting point and glass transition temperature of the copolymer of the sheath component can be any, but preferred is about 200° C. for melting point and 40 to 50° C. for glass transition temperature in view of fusion properties of the sheath components and shaping ability by heat and pressure.

A weight ratio of the core component and the sheath component can be within a range of core component: sheath component=0.3 to 5:1 (weight ratio). If the core component is lower than the range, shape retention after thermoforming would be lower. If it is higher than the range, the sheath components would have difficulty in fusion properties and surface fluffing would be severe. The core component and the sheath component can be disposed concentrically or eccentrically, but concentric disposition would be preferred because contraction would arise when heating if it is disposed eccentrically.

The sheath-core composite fiber can be obtained by art known method wherein a high melting point polyester for the core component and a low melting point copolymerized polyester for the sheath component are put in a spinning apparatus having composite spinning holes to melt spin. The sheath-core composite fiber can be either continuous filament or staple fiber, but the continuous filaments are preferred for obtaining high stiffness needle-punched nonwoven fabric. In order to obtain filamentous web using the sheath-core composite continuous filaments, so-called a spun bond method is generally employed. The sheath-core composite continuous filaments obtained by melt spinning are directly accumulated in the form of a sheet to obtain filamentous web. In the case of obtaining fibrous web from the sheath-core composite staple fibers, the staple fibers are passed through a card machine to open fibers and accumulated in the form of sheet. An amount of web can be 80 to 2,000 g/m$^2$. If the web is lighter than the range, its thickness becomes thin and, when it is subjected to embossing process, distinct rugged patterns are hardly obtained. If the web is heavier than the range, the resulting needle-punched nonwoven fabric would be stiff and difficult to heat form.

The web can be needle-punched either when the fibers are not fusion bonded with each other or when they are fusion bonded with each other. In the case of the former method, it is preferred that, since the fibers are not bonded with each other, needle-punching does not make damages on the fibers and does not cause reduction of strength by fiber breakage. In addition, in the case of the latter method, since the fibers are bonded with each other, the fibrous web can be easily treated or transported. The needle-punching can be conducted by any art known method and thereby the sheath-core composite fibers are three dimensionally interlaced to obtain a closely interlaced nonwoven fabric in which the fibers are aligned in the direction of thickness. In the case where the sheath-core composite fibers are bonded with each other, the needle-punching would break some of the bonding and would let the fibers three-dimensional interlaced. The punching density would be a level of about 10 to 200 punches/cm$^2$.

The needle-punched nonwoven fabric thus obtained is heated and pressed to thermoform to various shape. Typical example of the thermoforming is heat embossing. The heat embossing means a process wherein the needle-punched nonwoven fabric is passed through between a pair of heated embossed rolls (i.e. engraved rolls having engraved pattern on a surface) or between a flat roll and an embossed roll heated to form rugged pattern on a surface of the needle-punched nonwoven fabric. Since in the needle-punched nonwoven fabric the composite fibers are simply interlaced, but are not bonded therebetween, the heat embossing process strongly bonds the fibers with each other to form rugged pattern distinctively. Heating temperatures can be levels softening or melting the sheath components to melt bond the sheath-core composite fibers with each other. The heating temperature can be less than a softening point or a melting point of the sheath component of the sheath-core composite fibers, because the softening and bonding of the sheath components would generally be assisted and accelerated by the compression. Concretely the heating temperature can be a range level of 80° C. to 180° C. and the compression condition can be a range level of 10 to 150 kg/cm of linear pressure.

The thermoforming may also include a process shaping into a three dimensional shape, for example a plate shape, a bowl shape or the like. Concretely it can be shaped using a press mold into a three dimensional shape. In this case, the needle-punched nonwoven fabric may be heated and then pressure shaped by a press mold. The nonwoven fabric may also be shaped with heating by using a heated press mold. The thermoforming using the press mold can also bond between the sheath-core composite fibers by softening and melting the sheath components. A heating temperature of the thermoforming can be a range level of 100° C. to 200° C. and a pressure condition can be a range level of 10 to 500 kg/cm$^2$.

The thermoformed nonwoven fabric (such as an embossed nonwoven fabric) obtained by the present invention can be employed for many applications. Concrete examples of the applications include a filter substrate, a transpiration plate for a humidifier, a sound absorbing material (an anti-noise material), an interior part, a base cloth for a carpet, a base cloth for shoes or a bag, a cover sheet for a chair, a cloth for clothing, an interlining clothing, a mask against dust or for sanitary, and the like. The thermoformed nonwoven fabric shaped into a three dimensional shape can include an interior material for automobiles (such as a trim), a body of a child sheet, a various tray, a bag body or an interior material for a suitcase, an insole of shoes, a substitute of a plastic molded article obtained by injection molding, an enclosure for a home appliance and an office supplies (such as a vacuum cleaner, an air conditioner, a portable computer, a printer and the like), and the like.

Advantageous Effects of Invention

The needle-punched nonwoven fabric obtained by the process of the present invention is thermoformed by heating and compressing to obtain a distinct shape, because the sheath component of the sheath-core composite fiber is formed from a specific polyester copolymer. Concretely, if it is heat embossed, it creates a distinct rugged pattern, and if it is shaped into a three dimensional shape, the resulting molded article has excellent shape retention properties. In addition, since the specific sheath-core composite fibers are employed, it can show excellent moldability in various ranges of heating or compressing conditions.

EXAMPLE 1

A copolymer of ethylene glycol and terephthalic acid (a melting point of 260° C.) was prepared as a core component. A copolymer of ethylene glycol, diethylene glycol, adipic acid, terephthalic acid and isophthalic acid (a melting point of 200° C.) was prepared as a sheath component. The diol components contained 99 mole % of ethylene glycol and 1 mole % of diethylene glycol, and the dicarboxylic acids contained 19 mole % of adipic acid, 78 mole % of terephthalic acid and 3 mole % of isophthalic acid. Both of the core component and sheath component were provided into a spinning apparatus having composite spinning holes and then melt spun to obtain a sheath-core composite continuous filament. The sheath-core composite continuous filament had a weight ratio of core component:sheath component=7:3. The filaments were introduced into an air sucker located under the spinning apparatus and rapidly sucked and thinned, followed by open filaments by an art-known opening devise to collect and to accumulate on a moving screen conveyer to obtains filamentous web. The filamentous web was conveyed to a needle-punching machine and needle-punched at a punch density of 90 punches/cm$^2$ and a needle depth of 10 mm, to obtain a needle-punched nonwoven fabric having a weight of 300 g/m$^2$.

The resulting needle-punched nonwoven fabric was passed between a flat roll and an embossed roll having a grain leather pattern with a depth of 0.4 mm and heat embossed at an embossed roll temperature of 130° C. and a roll linear pressure of 50 kg/cm. The resulting embossed nonwoven fabric had a distinct grain leather pattern and had excellent designed pattern with excellent rubbing resistance and sufficient softness.

Comparative Example 1

The copolymer obtained in Example 1 was prepared as core component. A copolymer of ethylene glycol, diethylene glycol, terephthalic acid and isophthalic acid (a melting point of 230° C.) was prepared as sheath component. In the copolymer constituting the sheath component, the diol component contained 99 mole % of ethylene glycol and 1 mole % of diethylene glycol, and the dicarboxylic acid included 92 mole % of terephthalic acid and 8 mole % of isophthalic acid. Both of the core component and sheath component were provided into a spinning apparatus having composite spinning holes and then melt spun to obtain a sheath-core composite continuous filament. The sheath-core composite continuous filament had a weight ratio of core component: sheath component=6:4. The filaments were introduced into an air sucker located under the spinning apparatus and rapidly sucked and thinned, followed by open filaments by an art-known opening devise to collect and to accumulate on a moving screen conveyer to obtains filamentous web. The filamentous web was conveyed to a needle-punching machine and needle-punched at a punch density of 90 punches/cm$^2$ and a needle depth of 10 mm, to obtain a needle-punched nonwoven fabric having a weight of 300 g/m$^2$.

The resulting needle-punched nonwoven fabric was passed between a flat roll and an embossed roll having grain leather pattern with a depth of 0.4 mm and heat embossed at an embossed roll temperature of 200° C. and a roll linear pressure of 50 kg/cm. The resulting embossed nonwoven fabric had a distinct grain leather pattern, but when it was touched by a finger, had become fluffy in convex portions and had broken the bonding between the sheath-core composite filaments, thus making the rugged pattern indistinct. The needle-punched nonwoven fabric showed less softness than that of Example 1.

Comparative Example 2

Sheath-core composite staple fiber (available from Unitika Ltd., Number "2080", finess 4.4 dtex, fiber length 51 mm, core component: sheath component=1:1 weight ratio, sheath component having a melting point of 200° C.) was prepared. The core component of the sheath-core composite staple fiber was same with the copolymer of Example 1 and the sheath component was a copolymer of 99 mole % of ethylene glycol and 1 mole % of diethylene glycol as diol component and of 80 mole % of terephthalic acid and 20 mole % of isophthalic acid as dicarboxylic acid. The sheath-core composite staple fibers were opened and collected by a carding machine to obtain fibrous web which was then conveyed to a needle-punching machine and needle-punched at a punch density of 90 punches/cm$^2$ and a needle depth of 10 mm, to obtain a needle-punched nonwoven fabric having a weight of 300 g/m$^2$.

The resulting needle-punched nonwoven fabric was passed between a flat roll and an embossed roll having a grain leather pattern with a depth of 0.4 mm and heat embossed at an embossed roll temperature of 140° C. and a roll linear pressure of 50 kg/cm, but did not provide distinct rugged pattern, because the nonwoven fabric had large heat contraction and formed wrinkles.

Comparative Example 3

Polyester staple fiber (available from Unitika Ltd., Number "100", finess 2.0 dtex, fiber length 51 mm, a melting point of 260° C.) was prepared. 50% by weight of the polyester staple fibers and 50% by weight of the sheath-core composite staple fibers were uniformly mixed and were open-fibered and collected by a carding machine to obtain fibrous web which was immediately conveyed to a needle-punching machine and needle-punched at a punch density of 90 punches/cm$^2$ and a needle depth of 10 mm, to obtain a needle-punched nonwoven fabric having a weight of 300 g/m$^2$.

The resulting needle-punched nonwoven fabric was heat embossed as generally described in Comparative example 2, but did not provide a grain leather pattern, although it was soft. When it was touched by a finger, it became fluffy and showed poor rubbing resistance.

The invention claimed is:

1. A process for producing a needle-punched nonwoven fabric, which comprises the following steps:

forming a web by accumulating sheath-core composite fibers in which the core is formed from a copolymer of ethylene glycol and terephthalic acid and the sheath is formed from a copolymer of ethylene glycol, adipic acid, terephthalic acid, isophthalic acid, and diethylene glycol, wherein, in the sheath, a molar ratio of ethylene glycol to diethylene glycol is within a range of 10:0.05 to 0.5 and a molar ratio of isophthalic acid to adipic acid to terephthalic acid is within a range of 0.04 to 0.6:1:1 to 10, needle-punching the web to three-dimensionally interlacing the sheath-core composite fibers; and heating and pressing the needle-punched nonwoven fabric to form a desired shape.

2. The process of claim 1, wherein the sheath-core composite fiber is either sheath-core composite continuous filament or sheath-core composition staple fiber.

3. The process according to claim 1, wherein the desired shape is three dimensional stereoscopic shape.

4. The process according to claim 1, wherein the sheath-core composite fibers are melted with each other by heating and pressing the sheath components to soften or melt.

5. The process according to claim 1, wherein the needle-punched nonwoven fabric is simultaneously heated and pressed.

6. A process for producing an embossed nonwoven fabric, which comprises the following steps:

forming a web by accumulating sheath-core composite fibers in which the core is formed from a copolymer of ethylene glycol and terephthalic acid and the sheath is formed from a copolymer of ethylene glycol, adipic acid, terephthalic acid, isophthalic acid, and diethylene glycol, wherein, in the sheath, a molar ratio of ethylene glycol to diethylene glycol is within a range of 10:0.05 to 0.5 and a molar ratio of isophthalic acid to adipic acid to terephthalic acid is within a range of 0.04 to 0.6:1:1 to 10, needle-punching the web to three-dimensionally interlace the sheath-core composite fibers, thus obtaining a needle-punched nonwoven fabric; and passing the needle-punched nonwoven fabric through a heated emboss roll to form a rugged pattern on a surface and to soften or melt the sheath components to bond the sheath-core composite fibers with each other.

7. The process according to claim 1, wherein the needle-punched nonwoven fabric is heated and then pressed.

* * * * *